US007297851B2

(12) United States Patent
Caldwell et al.

(10) Patent No.: US 7,297,851 B2
(45) Date of Patent: Nov. 20, 2007

(54) GUITAR BRIDGE APPARATUS

(76) Inventors: Marcus Caldwell, 963 Elkton Dr., Colorado Springs, CO (US) 80997; Jeff Lathrop, 6570 Connie Lee Ct., Falcon, CO (US) 80831

( * ) Notice: Subject to any disclaimer, the term of this patent is extended or adjusted under 35 U.S.C. 154(b) by 0 days.

(21) Appl. No.: 11/426,335

(22) Filed: Jun. 26, 2006

(65) Prior Publication Data

US 2006/0288839 A1 Dec. 28, 2006

Related U.S. Application Data

(60) Provisional application No. 60/595,377, filed on Jun. 28, 2005.

(51) Int. Cl.
*G10D 3/00* (2006.01)

(52) U.S. Cl. ..... 84/313

(58) Field of Classification Search ..... 84/313, 84/312 R, 307, 311, 314 R
See application file for complete search history.

(56) References Cited

U.S. PATENT DOCUMENTS

| | | | | |
|---|---|---|---|---|
| 3,056,329 | A | 10/1962 | Butts | |
| 3,424,049 | A | 1/1969 | Daniel | |
| 4,295,404 | A | 10/1981 | Smith | |
| 4,497,236 | A | 2/1985 | Rose | |
| 4,649,788 | A * | 3/1987 | Matsui | 84/297 R |
| 4,742,750 | A | 5/1988 | Storey | |
| 4,768,415 | A | 9/1988 | Gressett, Jr. et al. | |
| 4,779,506 | A | 10/1988 | Takeuti | |
| 4,811,646 | A | 3/1989 | Hoshino | |
| 4,967,631 | A | 11/1990 | Rose | |
| 5,088,374 | A | 2/1992 | Saijo | |
| 5,196,641 | A | 3/1993 | Schaller | |
| 5,373,769 | A | 12/1994 | Sherman | |
| 5,413,019 | A | 5/1995 | Blanda, Jr. | |
| 5,419,227 | A | 5/1995 | Lavineway | |
| 5,429,028 | A | 7/1995 | Fisher, IV | |
| 5,520,082 | A * | 5/1996 | Armstrong et al. | 84/313 |
| 5,522,297 | A | 6/1996 | Enserink | |
| 5,672,835 | A | 9/1997 | Doughty | |
| 5,708,225 | A | 1/1998 | Sherman | |
| 6,046,393 | A | 4/2000 | Rose | |
| 6,084,166 | A * | 7/2000 | Lee | 84/313 |
| 6,198,030 | B1 | 3/2001 | Rose | |
| 6,198,036 | B1 | 3/2001 | Hoshino | |
| 6,300,550 | B1 | 10/2001 | Smith | |
| 6,867,354 | B2 | 3/2005 | Shimooka et al. | |

* cited by examiner

*Primary Examiner*—Kimberly Lockett

(57) ABSTRACT

A bridge assembly for a guitar having a bridge plate connected to an anchor plate by a single, horizontally positioned flat spring. The bridge plate has an opening that receives a portion of a sustain block. The sustain block has receptacles for receiving fine tuners and string clamps. Intonation screws extend through flange openings on the bridge plate and are adjustably connected to saddles. A locking nut is positioned on the neck of the guitar having a plurality of pieces connected by a tensioning bolt. At least one piece has one or more stabilizing flanges.

2 Claims, 8 Drawing Sheets

GUITAR BRIDGE APPARATUS

CROSS REFERENCE TO RELATED APPLICATION

This application is a continuation of U.S. Ser. No. 60/595,377 filed Jun. 28, 2005.

BACKGROUND OF THE INVENTION

The present invention is directed to guitar bridges and more particularly to vibrato style guitar bridges.

The Fender Stratocaster was introduced in the early 1950s and it has since become one of the most popular electric guitars of all time. The vibrato bridges (sometimes referred to as tremolo) found on the Stratocaster and other similar guitars are all affected by a similar problem; the strings go out of tune (i.e. sharp) when the vibrato arm is depressed and then released.

Several products currently on the market are designed to correct the inherent design flaws of tremolo style bridges. The two most popular models are the Floyd Rose and Wilkinson vibratos. The Wilkinson vibrato offers improved quality construction as compared with the original Stratocaster hardware, but does not solve the inherent tuning problem. The Floyd Rose vibrato design does address the tuning problem; however, other difficulties remain. Specifically, the Floyd Rose vibrato design is complicated, has a non-traditional look, and does not fit well with vintage guitars. Additionally, both the Floyd Rose and Wilkinson vibratos require extensive and irreversible modification of the guitar body and neck.

Locking nuts are also known in the art to assist in maintaining the tuning of the strings. Known locking nuts, however, require that the head stock be modified. Accordingly, there exists a need in the art for a bridge and locking nut that address the problems in the art.

SUMMARY OF THE INVENTION

A bridge assembly for a guitar having a bridge plate connected to an anchor plate by a flat spring. A single flat spring is positioned parallel to the guitar body to allow for movement between the anchor plate and the bridge plate yet support the tension of the strings without bending. The bridge plate has an opening that receives a portion of a sustain block. The block bridge plate provides for secure mounting of the sustain block via mounting screws. The sustain block has receptacles for receiving fine tuners and string clamps. Intonation screws extend through flange openings on the bridge plate and are adjustably connected to saddles. A locking nut is positioned on the neck of the guitar having a plurality of pieces connected by a tensioning bolt. At least one piece has one or more stabilizing flanges.

DETAILED DESCRIPTION OF THE PREFERRED EMBODIMENT

Figure 1:
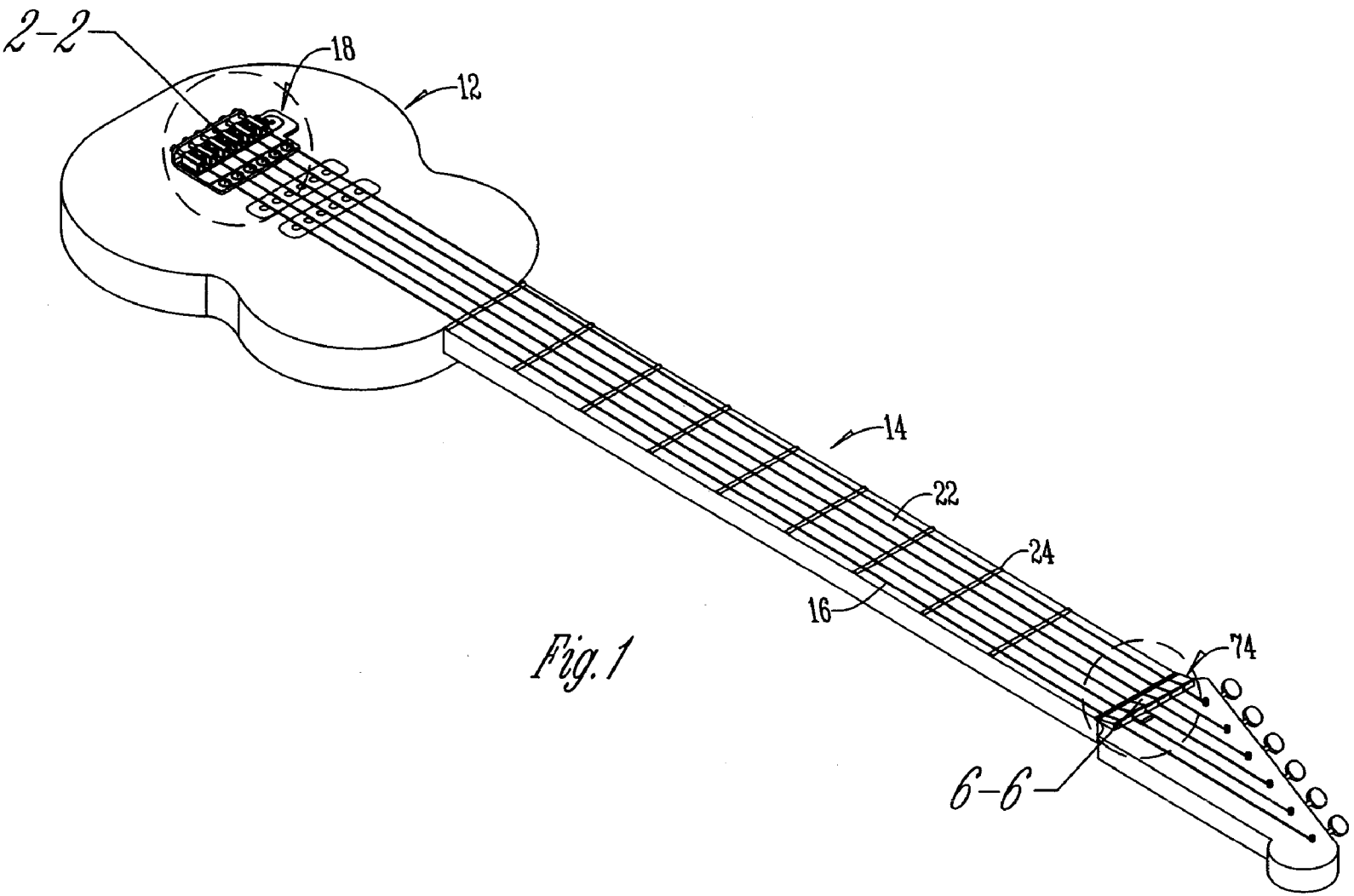
FIG. 1 is a perspective view of a guitar with a bridge apparatus.
Figure 2:
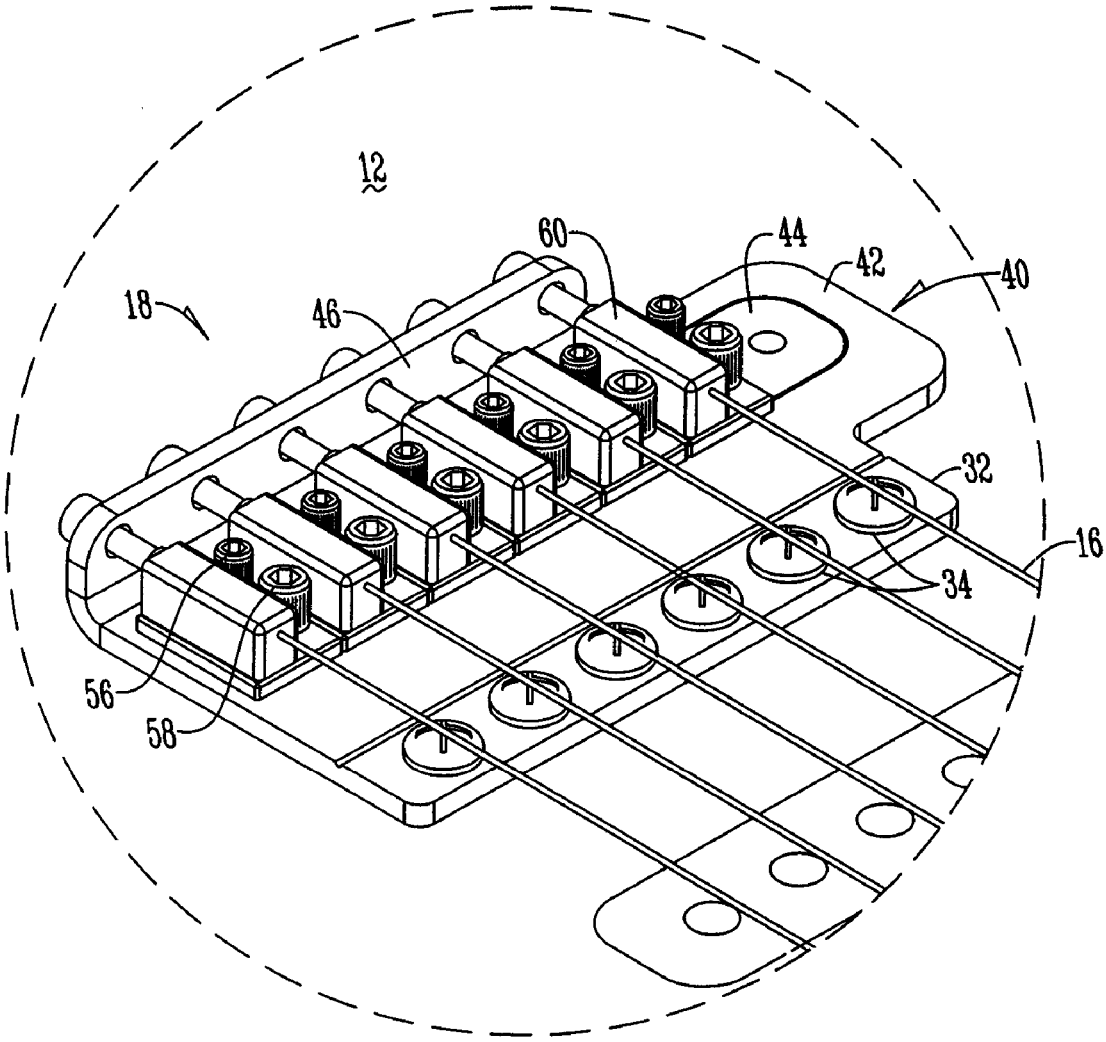
FIG. 2 is a plan view of a bridge apparatus.
Figure 3:
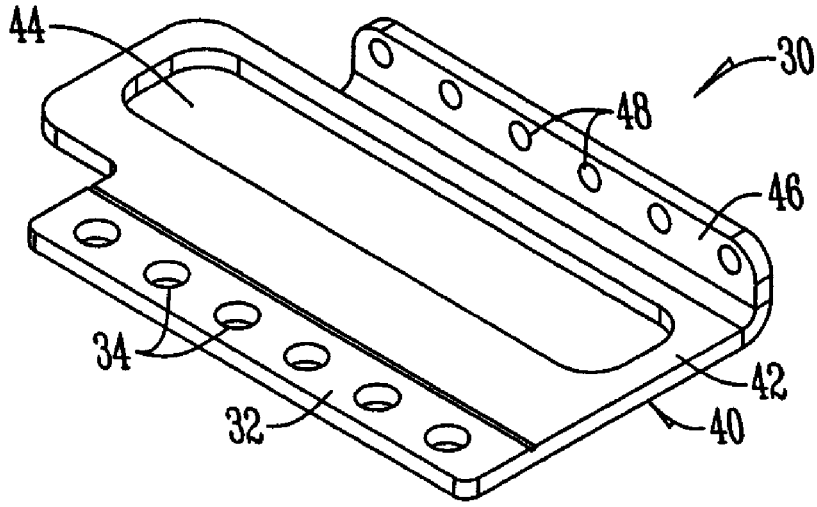
FIG. 3 is a perspective view of an anchor plate connected to a bridge plate.
Figure 4:
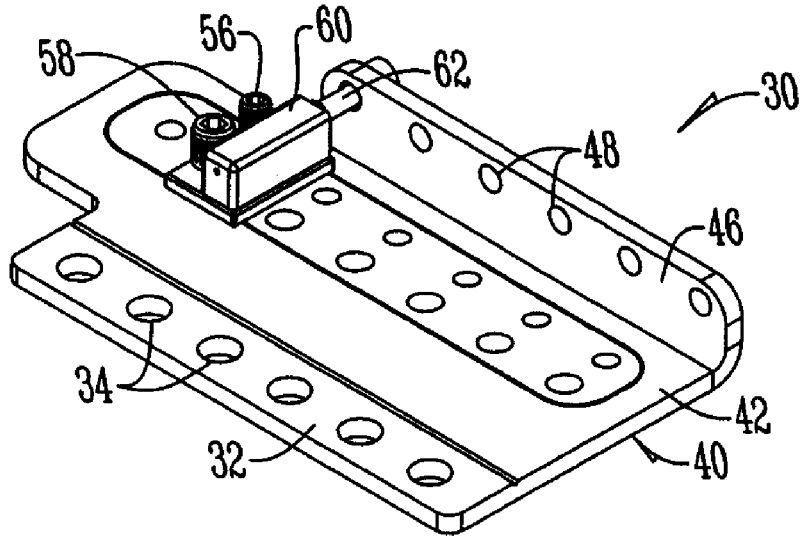
FIG. 4 is a perspective view of an anchor plate connected to a bridge plate.
Figure 5:
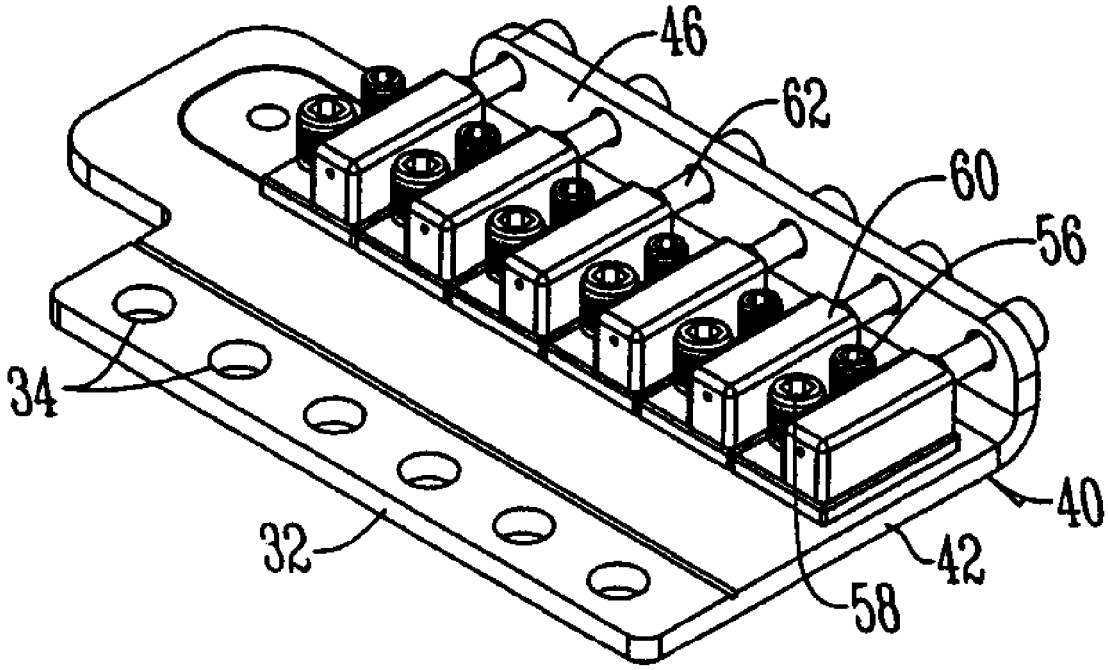
FIG. 5 is a perspective view of a bridge assembly.
Figure 6:
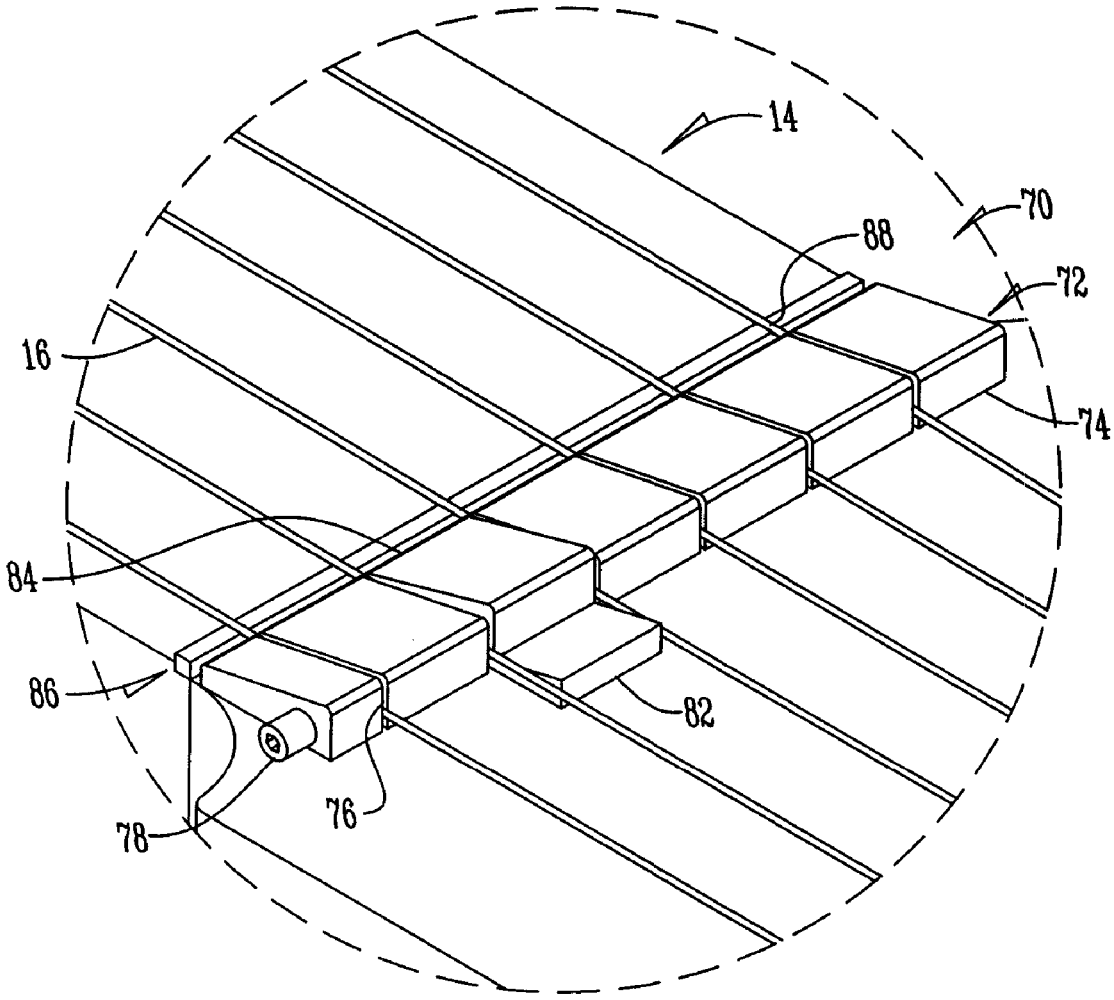
FIG. 6 is a plan view of a locking nut.

Referring to the figures, a guitar 10 includes a guitar body 12 having a neck 14 extending therefrom. Strings 16 extend from a bridge 18 to tuning pegs 20 along the guitar 10. The strings 16 are positioned over a finger board 22 on the neck 14, where the finger board 22 includes frets 24 extending therefrom.

A bridge assembly 30 includes an anchor plate 32 having through holes 34 formed therein. Screws 36 are received within through holes 34 and rigidly secure the anchor plate 32 to the guitar body 12.

A flat spring or springs 38 are flexibly secured between the anchor plate 32 and a bridge plate 40. The flat spring 38 may preferably be formed of spring tempered steel, or any other suitable material. The flat spring 38 is adapted to repeatedly bend without permanent deformation and applies bias force on the bridge plate 40 with respect to the anchor plate 32. The flat spring 38 also serves to accurately locate the bridge assembly with regard to the guitar body 12 so the bridge plate returns to its exact starting position. The flat spring additionally serves as a very rigid yet completely frictionless pivot point. Due the geometry of the bridge design, only one flat spring is required positioned horizontally and parallel to the guitar body.

The bridge plate 40 includes a main body 42 having a rectangular block opening 44 located therein. A vertical flange 46 extends perpendicularly from the main body 42 and includes openings 48 located therein.

A sustain block 50 is located beneath the main body 42. At least a portion of the sustain block 50 is located within the block opening 44 of the bridge plate 40 and is (permanently welded) rigidly attached in place. The sustain block 50 includes a plurality of fine tuner receptacles 52 and a plurality of string clamp receptacles 54 formed as apertures or slots in the portion of sustained block 50 located within the block opening 44 of bridge plate 40. The fine tuner receptacle 52 receives at least a portion of a fine tuner 56 when a fine tuner 56 is secured to the sustain block 50. Similarly, string clamp receptacle 54 receives at least a portion of a string clamp 58 when the string clamp 58 is secured to the sustained block 50.

A plurality of height adjustable saddles 60 are positioned above the bridge plate 40 opposite the sustain block 50. Each saddle is individually adjustable to compensate for various fret board radii. The saddle adjusts screws 62 are adapted to adjust the height of the saddles 60 with respect to the bridge plate 40. A plurality of intonation adjust screws 62 extend through the openings 48 of the vertical flange 46 to adjustably connect to saddles 60.

A locking nut 70 is positioned on the neck 14 beneath strings 16. Locking nut 70 includes a main nut body 72 preferably formed of a single piece with machined slots 71 or a plurality of nut pieces 74 placed adjacent to one another with openings 76 formed therebetween. A tensioning bolt or bolts 78 connect the nut pieces 74 together. The tensioning nut 78 clamps the strings 16 located within the openings 76.

One or more of the nut pieces 74 is formed as a stabilizing piece 80 with flanges 82, 84 extending therefrom. As shown the stabilizing piece 80 is a single centrally located flange. Alternatively, depending on the headstock shape, the stabilizing piece 80 is configured with two or more stabilizing flanges. Flange 82 of the stabilizing piece 80 extends from the main nut body ,72 towards the tuning peg 20 end of guitar 10 and engages the head stock 85. Flange 84 of the stabilizing piece 80 extends opposite flange 82 towards the guitar body 12 and engages nut 86. The nut 86 includes string grooves 88 for receiving strings 16 therein.

In operation, the bridge assembly 30 and locking nut 70 operate keep guitar 10 in tune when the vibrato is used. The bridge assembly 30 and locking nut 70 fit all Fender Stratocasters and Stratocaster copies made throughout the world. No modifications to the neck 14 or guitar body 12 are required for installing either the bridge assembly 30 or the locking nut 70. The bridge assembly 30 and the locking nut 70 maintain a traditional/classic look and playability to the guitar 10 when installed. The flat spring 38 feature of the bridge assembly 30 provides an improved pivot design that eliminates wear and friction on the bridge assembly 30. The strings are clamped in place with the tensioning bolt 78. The tensioning bolt can be repeatably loosened and re-tightened for string changes. The locking nut maintains a stable position in the transverse and longitudinal directions due to the centrally located stabilizing piece and the downward force of the strings on the nut.

The bridge assembly 30 and locking nut 70 of the present invention addresses the inherent problem of "de-tuning" of the strings during vibrato use. The present invention fits the vintage "look and feel", and is of simple design with relatively few parts. Additionally, the present invention installs without requiring modification to the neck 14 or guitar body 12 of a guitar 10.

Figure 7:
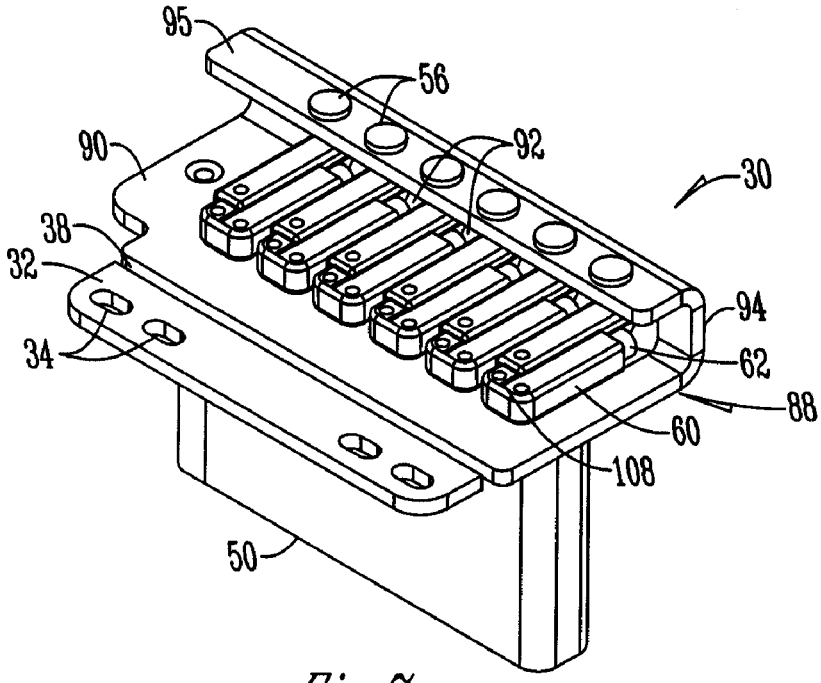
FIG. 7 is a perspective view of a bridge assembly.
Figure 8:
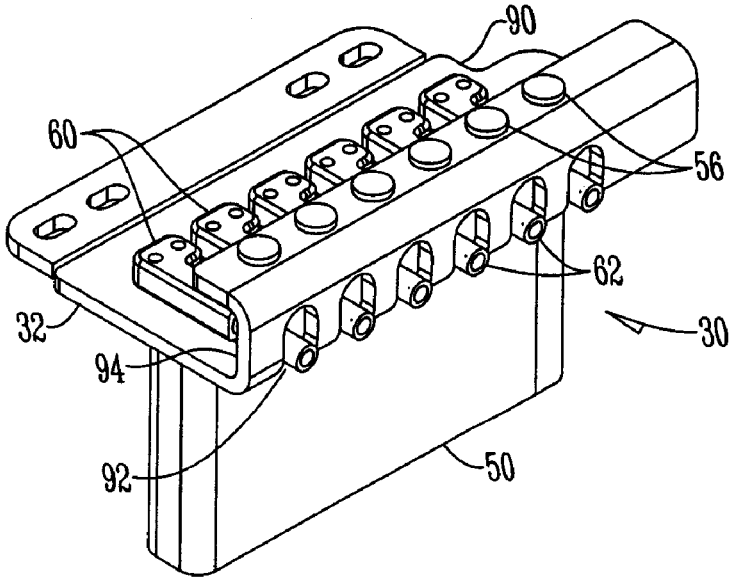
FIG. 8 is a perspective view of a bridge assembly.
Figure 9:
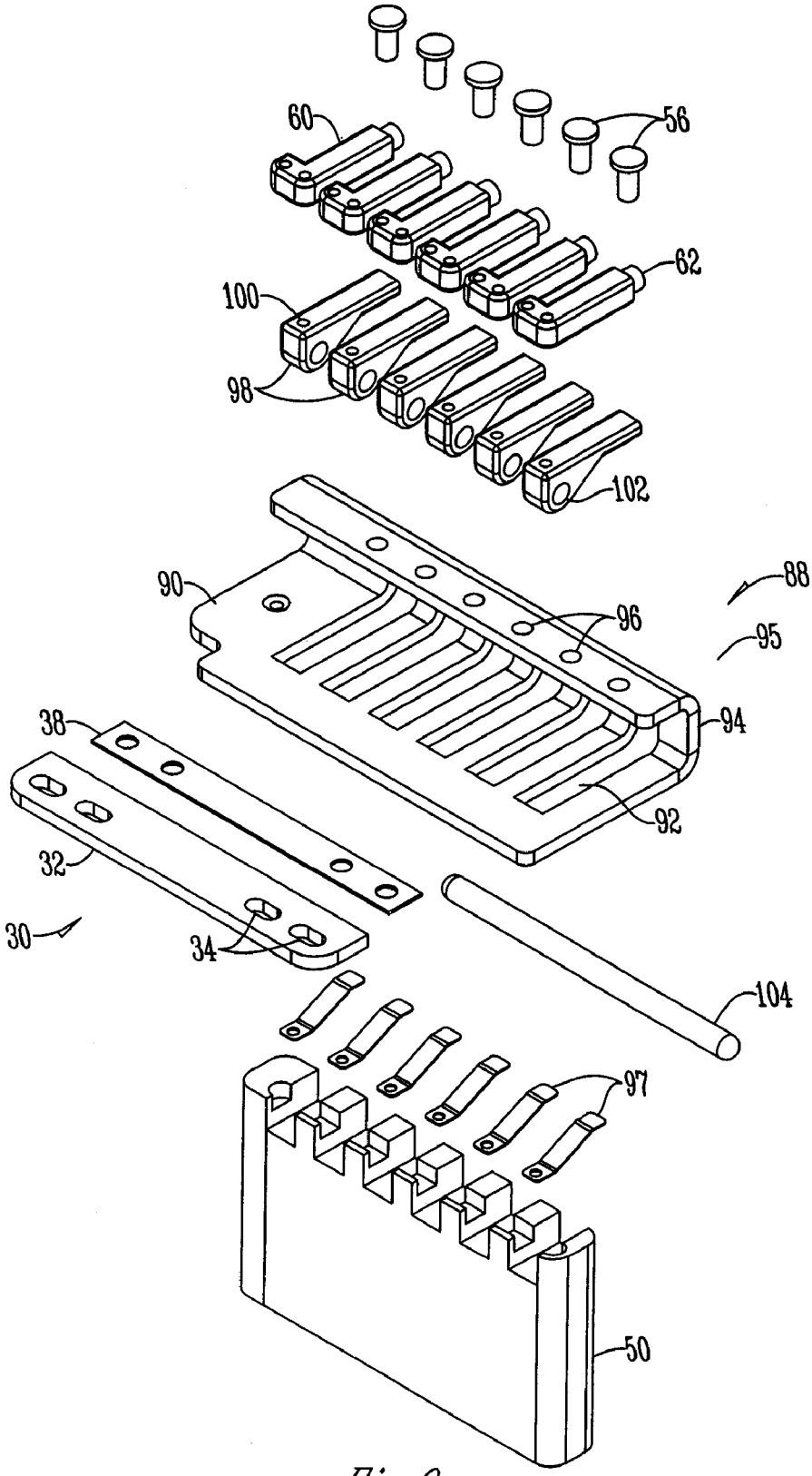
FIG. 9 is an exploded view of a bridge assembly.
Figure 10:
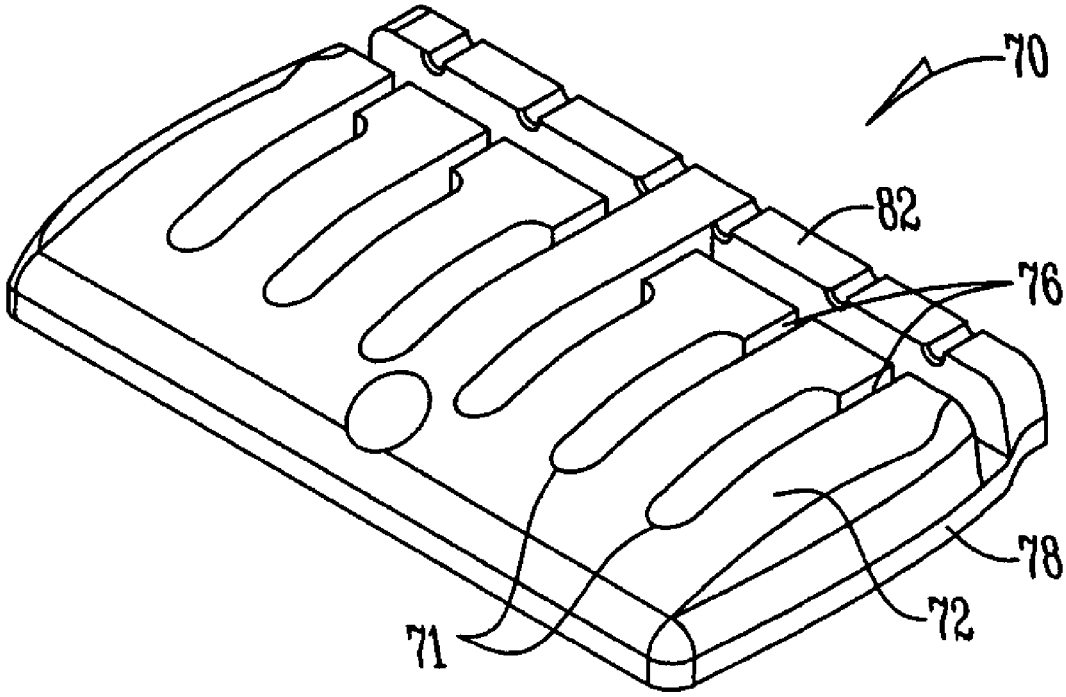
FIG. 10 is a perspective view of a locking nut.

In an alternative embodiment, as shown in FIGS. 7, 8, and 9 the bridge assembly 30 includes an anchor plate 32 having through holes 34 formed therein. Screws 36 are received within through holes 34 and rigidly secure the anchor plate 32 to the guitar body 12. A flat spring or springs 38 are flexibly secured between the anchor plate 32 and a bridge plate 88. The flat spring 38 may preferably be formed of spring tempered steel or any other suitable material. The flat spring 38 is adapted to repeatedly bend without permanent deformation and applies bias force on the bridge plate 88 with respect to the anchor plate 32. The flat spring 38 also serves to accurately locate the bridge assembly 30 with regard to the guitar body 12 so the bridge plate returns to its exact starting position. The flat spring additionally serves as a very rigid yet completely frictionless pivot point. The flat spring is positioned parallel to the guitar body in its resting state providing rigid support for the string tension and still allow movement between the anchor plate and bridge assembly.

The bridge plate 88 includes a main body 90 having a plurality of grooves 92. A vertical flange 94 extends perpendicularly from the main body 90 and terminates in a horizontal shelf 95. The shelf 94 has a plurality of apertures 96 that receive a plurality of fine tuners 56.

A sustain block 50 is located beneath the main body 90 and at least a portion of the sustain block 50 extends through grooves 92 connected to the sustain block are a plurality of return springs 97 and a plurality of rocker arms 98. The rocker arms 98 are generally L-shaped with a vertical bore 100 for receiving a string 16 and a horizontal bore 102 for receiving a rod 104. The rod 104 extends through bores 102 such that the rockers 98 pivot about the rod 104 and are biased by the return springs 97. The rod is secured in a longitudinal groove located in the sustain block and captured by the bridge plate above.

A plurality of height adjustable saddles 60 are connected to the intonation screws protruding through the vertical flange of the bridge plate and biased by individual springs (rocker arms 98). Each saddle 60 is individually adjustable to compensate for various fret board radii. The saddle adjacent screws 62 are adapted to adjust the height of the saddles 60. The string 16 that is received within vertical bore 100 of the rocker arm 98 extends over the end 106 of the rocker arm 98 and through slot 108 formed within saddle 60.

It is therefore seen that the bridge assembly and locking nut of the present invention will accomplish at least all of its stated objectives.

What is claimed:

1. A bridge assembly for use with a guitar, comprising:

a bridge plate having a main body with a body opening and a vertical flange with a plurality of flange openings;

a sustain block with a portion located within the body opening, the sustain block having a plurality of fine tuner receptacles that receive a portion of a fine tuner and a plurality of string clamp receptacles that receive a portion of a string clamp;

a plurality of adjustable saddles mounted above the main body of the bridge plate, and at least one intonation screw that extends through the flange opening and is adjustably connected to the saddle wherein an anchor plate is connected to the main body of the bridge plate by a flat spring.

2. The assembly of claim 1 wherein the flat spring is positioned horizontally and parallel to the guitar.

* * * * *